US007264343B2

(12) United States Patent
Harvey et al.

(10) Patent No.: US 7,264,343 B2
(45) Date of Patent: Sep. 4, 2007

(54) DROPLET DEPOSITION APPARATUS

(75) Inventors: Robert Harvey, Cambridge (GB); Stephen Temple, Cambridge (GB); Howard J. Manning, Edinburgh (GB)

(73) Assignee: Xaar Technology Limited, Cambridge (GB)

( * ) Notice: Subject to any disclaimer, the term of this patent is extended or adjusted under 35 U.S.C. 154(b) by 314 days.

(21) Appl. No.: 10/488,714

(22) PCT Filed: Sep. 4, 2002

(86) PCT No.: PCT/GB02/04023

§ 371 (c)(1),
(2), (4) Date: Aug. 9, 2004

(87) PCT Pub. No.: WO03/022585

PCT Pub. Date: Mar. 20, 2003

(65) Prior Publication Data

US 2004/0263593 A1 Dec. 30, 2004

(30) Foreign Application Priority Data

Sep. 7, 2001 (GB) ..... 0121625.8

(51) Int. Cl.
*B41J 2/175* (2006.01)
*B41J 2/05* (2006.01)

(52) U.S. Cl. ..... 347/93; 347/65

(58) Field of Classification Search ..... 347/34, 347/71, 93, 47, 65
See application file for complete search history.

(56) References Cited

U.S. PATENT DOCUMENTS 4,727,378 A 2/1988 Le et al. ..... 346/1.1
5,734,399 A * 3/1998 Weber et al. ..... 347/65

FOREIGN PATENT DOCUMENTS

| | | |
|---|---|---|
| EP | 277 703 A1 | 8/1988 |
| EP | 278 590 A1 | 8/1988 |
| EP | 714 778 A1 | 6/1996 |
| JP | 51-77036 | 7/1976 |
| WO | WO 00/38928 | 7/2000 |

OTHER PUBLICATIONS

International Search Report in PCT/GB02/04023 dated Jan. 13, 2003.

* cited by examiner

*Primary Examiner*—Matthew Luu
*Assistant Examiner*—Lisa M Solomon
(74) *Attorney, Agent, or Firm*—Marshall, Gerstein & Borun LLP

(57) ABSTRACT

An ink jet printer with ink flowing through an ink chamber and over an ink ejection port leading to a nozzle has a deflection surface such as a chamfer at the junction of the chamber and the ejection port to inhibit debris from entering the port.

8 Claims, 10 Drawing Sheets

*Fig. 2* *(Prior Art)*

DROPLET DEPOSITION APPARATUS

This is the U.S. national phase of International Application No. PCT/GB02/04023 filed Sep. 4, 2002, the entire disclosure of which is incorporated herein by reference.

The present invention relates to inkjet printers and in particular drop on demand ink jet printers.

Ink jet printers are no longer viewed simply as office printers, their versatility means that they are now used in digital presses and other industrial markets. It is not uncommon for the print heads to contain in excess of 500 nozzles and it is anticipated that "page wide" print heads containing over 2000 nozzles will be commercially available in the near future. These large print heads tend to be static heads and are capable of printing over 120 A4 photographic quality images per minute.

A nozzle of an ink jet print head is typically below 50 μm in diameter and is therefor subject to blocking by both dirt particles within the ink and paper fibres from the media. Various maintenance routines and techniques such as capping, wiping and purging can remove these blockages. Where a scanning print head is used, nozzle blockages can be disguised using well known image processing or printing routines until a maintenance step is performed.

A page wide digital press is able to print around 100 colour pages a minute. Because there is no scanning, it is not possible to disguise a nozzle blockage by firing a different nozzle whilst at the location of the blocked nozzle and therefore a maintenance routine is performed whenever a problem occurs. Since a maintenance routine can take several minutes to complete, this can result in the loss of several hundred pages that could have been printed not to mention the several hundred feet of paper that passes beneath the print head during the maintenance operation.

Clearly it is important that the print head remains free of blockages for as long as possible to ensure that printing time is maximised and paper waste is minimised.

It has been proposed to filter the ink prior to its entry into the print head and this is still a sensible approach. However, even with filters, particles of a size sufficient to block a nozzle or air may still find their way into the ejection chambers.

It is of course possible to reduce the pore size of the filter to trap smaller and smaller particles. As will be understood the smaller pore sizes also result in an increased pressure drop across the filter which may be unacceptable.

In the prior art of WO 00/38928 there is provided a print head arrangement where ink flows continually past the nozzle with a volumetric flow rate of about ten times the maximum ejection rate. The ejection ports of this print head which lead to the ejection nozzles are formed with an angle of 90° in relation to the longitudinal axis of the channel. It has been found that this flow rate in conjunction with an upstream filter reduces the probability of dirt particles or air bubbles blocking the nozzles. However there is still, especially where the ink used is particularly "dirty" or the filter fails for some reason a possibility of dirt becoming entrained in the nozzle.

The present invention provides a droplet deposition apparatus that seeks to increase the time between maintenance steps and to address other problems.

According to the present invention there is provided a droplet deposition apparatus comprising at least one ejection chamber extending between, a fluid inlet and a fluid outlet thereof and including an ejection port located between the fluid inlet and the fluid outlet and having an inlet for receiving from that chamber ejection fluid for ejection from a nozzle outlet thereof, actuator means acting upon said ejection chamber for applying a pressure to ejection fluid flowing through the ejection chamber; and means provided adjacent said ejection port inlet for preventing detritus in said ejection fluid flowing between said fluid inlet and fluid outlet from entering said port.

In a preferred embodiment there is provided droplet deposition apparatus comprising at least one ejection chamber each extending between a fluid inlet and a fluid outlet thereof and including an ejection port located between the fluid inlet and the fluid outlet and having a chamfered edge to an inlet for receiving from that chamber ejection fluid for ejection from a nozzle outlet thereof.

Preferably the configuration and size of the chamfer and the flow rate of the fluid along the channel and past the port (which is preferably between 8 and 30 times the maximum droplet ejection volume) are selected such that the possibility of a dirt particle becoming lodged in a nozzle is reduced to an acceptable level.

The channel is preferably one of a number similar channels extending parallel to one another to form an array.

The chamfer should preferably have an entry angle of between 10° and 70° with reference to the base of the channel and in an alternative construction, the diameter of the chamfer inlet extends beyond at least one of the sides of the ejection chamber.

In a second embodiment of the present invention there is provided at least one ejection chamber each extending between a fluid inlet and a fluid outlet thereof and including an ejection port located between the fluid inlet and the fluid outlet and having an inlet for receiving from that chamber ejection fluid for ejection from a nozzle outlet thereof, a filter being provided between said chamber and said ejection port inlet for preventing detritus in ejection fluid flowing between said fluid inlet and fluid outlet from entering said port.

It is preferred that the orifices in the filter plate are between 2 and 10 times smaller than the port in the cover plate.

Preferably said filter is a perforated plate and forms one wall of said at least one ejection chamber. Even more preferably the filter forms one wall of a plurality of said at least one ejection chambers.

In another aspect of the invention, there is provided droplet deposition apparatus comprising an elongate chamber extending between a fluid inlet and a fluid outlet; an fluid supply providing in use for a flow along the length of the chamber of velocity $V_T$; an ejection port located between the fluid inlet and the fluid outlet and directed orthogonally of the length of the chamber, there being detritus in the supplied fluid having a drift velocity $V_D$ in the direction of the ejection port, wherein there is provided a deflection surface opposing the fluid inlet at the junction of the chamber and the ejection port to deflect into the chamber detritus drifting into the ejection port.

Advantageously, the angle of the deflection surface to the length of the chamber is greater than $\tan^{-1}(V_D/V_T)$ and preferably greater than $\tan^{-1}(2(V_D/V_T)$ and, suitably, the angle of the deflection surface to the length of the chamber is less than $\tan^{-1}(V_T/V_D)$and preferably less than $\tan^{-1}(\frac{1}{2}(V_T/V_D)$.

Usefully, the deflection surface is defined as a chamfer between orthogonal surfaces of the ejection port and the chamber, respectively.

The invention is further illustrated by way of example, with reference to the accompanying drawings, in which.

Figure 1:
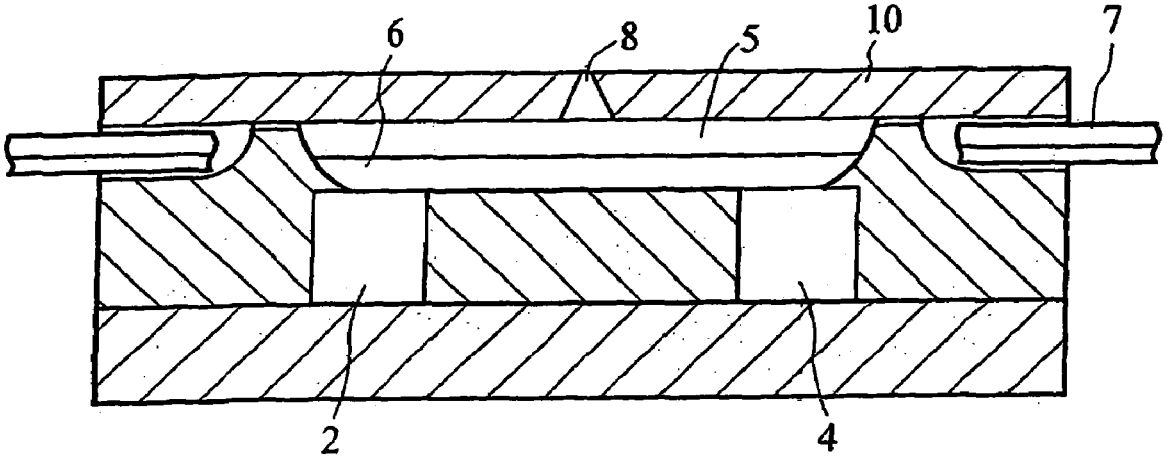
Fig. 1 (Prior Art)
FIG. 1 is a double-ended print head according to the prior art.

In a print head according to the prior art as depicted in FIG. 1, it is known to have a double ended channel, ink is supplied from two manifolds 2,4 and ejected from a nozzle 8 formed in a nozzle plate 10 located at the centre of the channel 6. The channel is sawn using a diamond-impregnated circular saw, in a block of a piezoelectric ceramic and in particular PZT. The PZT is polarised perpendicular to the direction of elongation and parallel to the surface of the walls that bound the channel. Independent electrodes 5 are formed on either side of the walls by an appropriate method and are connected to a driver chip (not shown) by means of electrical connectors 7. Upon application of a field between the electrodes on opposite sides of the wall, the wall deforms in shear to apply pressure to the ink in the channel. This process is well known e.g. from EP-A-0 277 703 and EP-A-0 278 590 amongst others and incorporated herein by reference.

Figure 2:
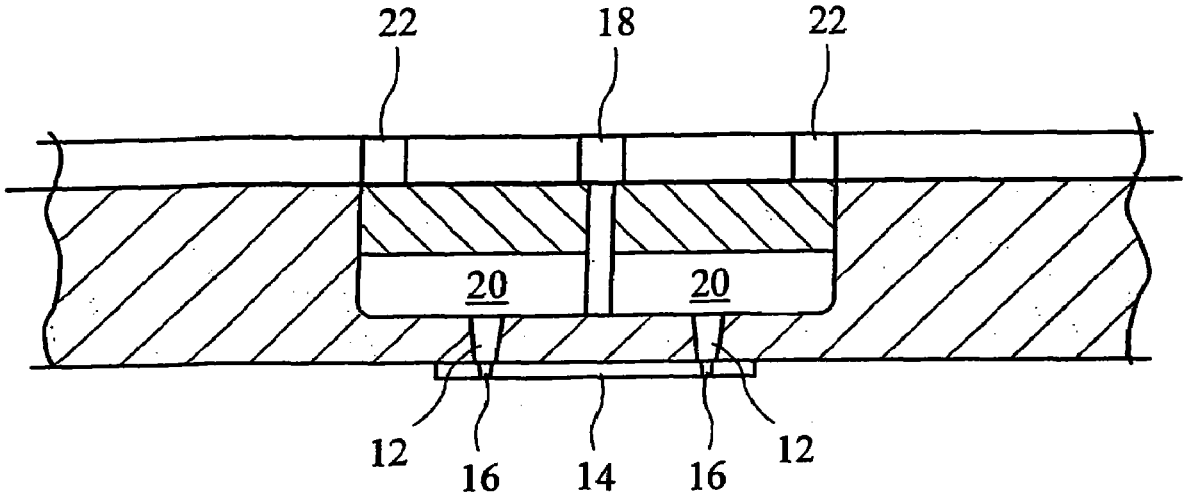
FIG. 2 is a through flow print head according to the prior art.

In another print head of the prior art as shown in FIG. 2, ports 12 are formed in a moulded piezoelectric base. A nozzle plate 14 is provided that contains nozzles 16. Ink is supplied to the ejection chambers 20 through a central inlet port 18 and removed through ports 22 located at the opposite ends of the ejection chambers. It is noted in the specification that ink can optionally be circulated through each of the chamber segments 20 for cleaning purposes.

The ports 12 are tapered to aid removal of the piezoelectric material from the mould. Thus, the angle of the ports is relatively acute and typically below 5°.

Figure 3:
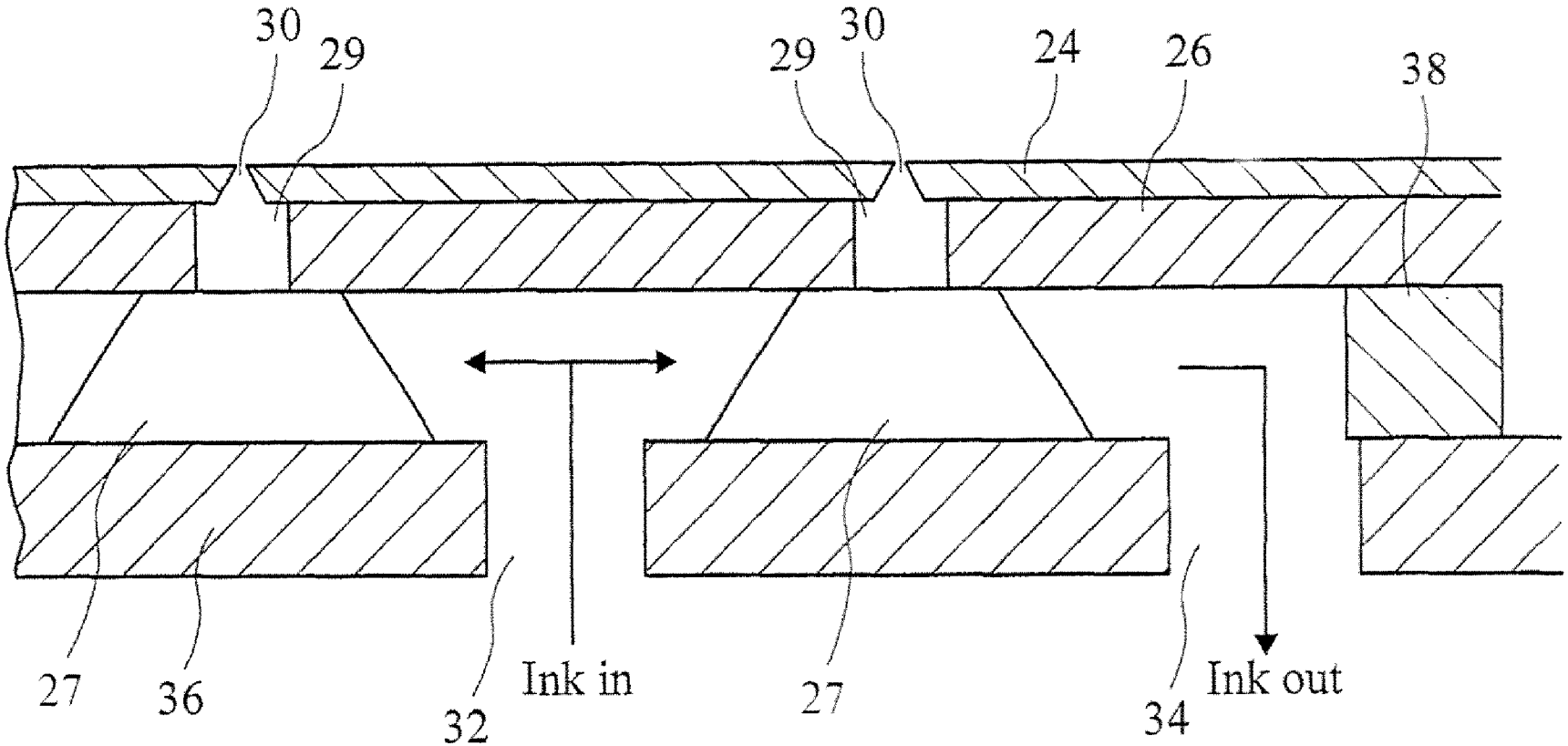
Fig. 3 (Prior Art)
FIG. 3 is a through flow print head according to the prior art.

In a further print head of the prior art and depicted in FIG. 3, a nozzle plate 24 is bonded to a cover component 26 that is further bonded to walls bounding the ejection channels. The cover component has a straight edged port 29 connecting the nozzles 30 and the ejection channels 27. Ink flows through the channels from manifolds 32 and 34 formed in a base component 36. Manifold 32 acts as an ink inlet whilst to manifold 34 situated at the opposite end of the channel to the ink inlet acts as an outlet manifold. Ink flows through the channels—even during printing.

This flow of ink increases the possibility of dirt particles or detritus in the ink remaining in the ink and not being entrained in the nozzles. However, it has been found that there is still a reasonable chance of detritus being entrained in the nozzles.

Without wishing to be bound by the theory, the applicant believes that the entrainment is caused by both gravity and ejection effects on the dirt particles or air bubbles. Where the print head is arranged to fire downwards the dirt particles, having a greater density than the fluid, tend to drift towards the nozzles under the influence of gravity. If the print head is arranged to fire vertically upwards then air bubbles, having a lower density than the fluid, tend to drift towards the nozzles. The actuators acting on the ejection channel generate a movement of ink towards the nozzle and any dirt or air is similarly pushed towards the nozzle by this movement of ink, even where the actuator is arranged to fire horizontally.

It is generally not possible to avoid debris entrapment simply by removing the cover plate, because the cover component serves to provide structural stability to the nozzle. Where a nozzle plate is used in isolation it has been found to be unable to survive the rigours of the high throughflow of ink or provide sufficient stiffness to maintain the pressure in the chamber upon actuation without flexing.

The problem therefore remains of avoiding or reducing the likelihood of detritus becoming trapped in an ink ejection port.

This problem and the manner in which the problem is solved by the present invention will now be described with reference to FIGS. 3 to 11.

Figure 4:
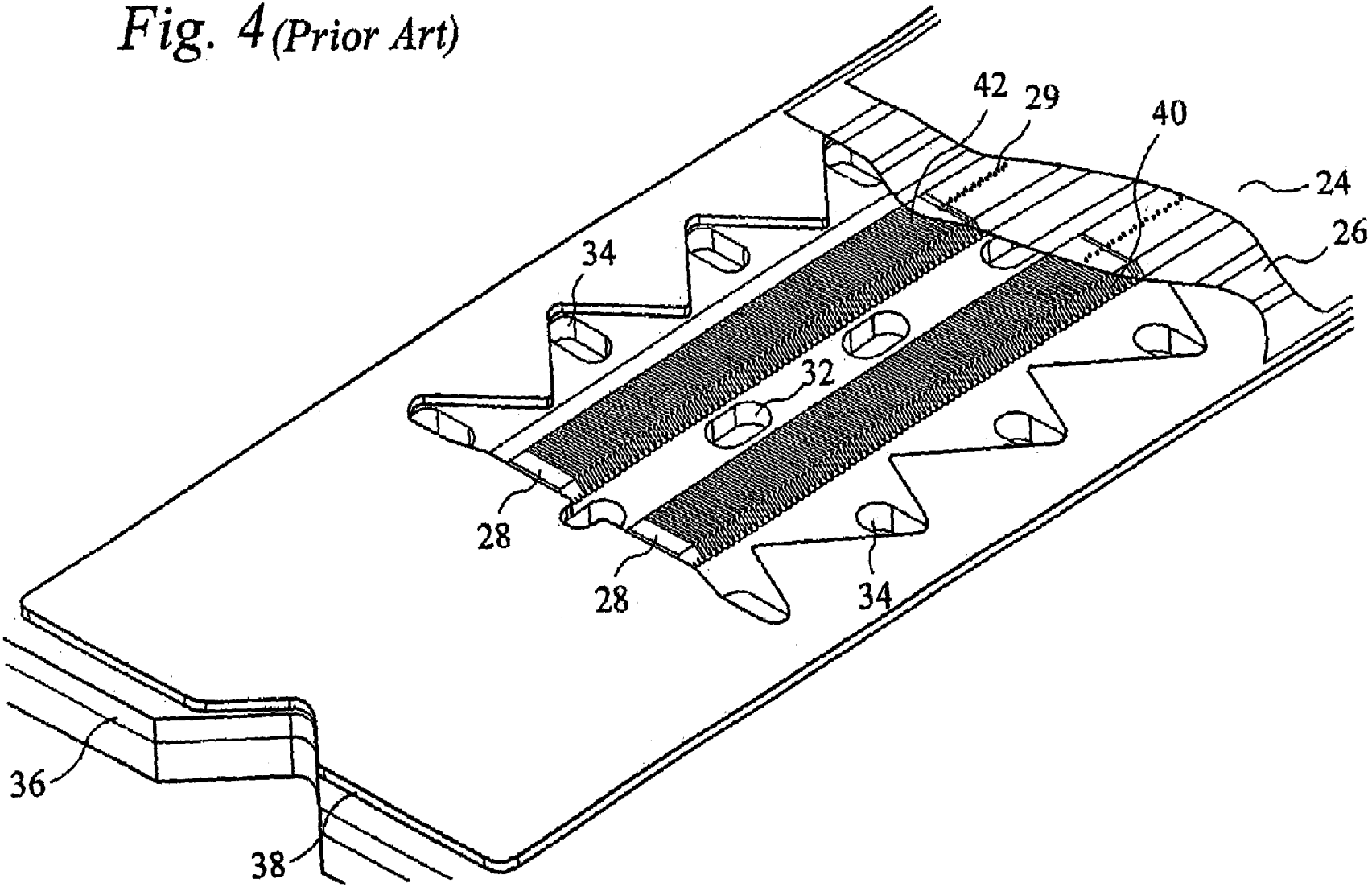
Fig. 4 (Prior Art)
FIG. 4 is an exploded perspective view of the print head of FIG. 3.

In the print head of FIGS. 3 and 4, ink is supplied to two rows of channels 40,42 formed in blocks of piezoelectric material 28 through a central manifold 32. The ink is pre-filtered before entering the head to remove any large particles and is circulated through the channels at a speed of the order ten times the maximum printing rate in order to reduce the chance of blockage of the nozzles. The un-printed ink subsequently flows through the outlet ports 34 to a reservoir where it is prepared for re-circulation.

The channels 40,42 typically have a width of 75 μm and a height of 300 μm. The diameter of the hole in the cover is of the order 100 μm. The head is capable of printing drops between 3 pl and 50 pl at a frequency of the order 6.2 kHz which means that the greatest flow rate through the nozzles is $3.1\times10^{-10}$ $m^3/s$. At 10 times this amount, the velocity of the ink along the channels is 0.14 m/s.

The Reynolds number $v_p D/\mu$ associated with the through flow is evaluated using as a characteristic length the hydraulic diameter D=4A/P, where A is the cross sectional area of the channel and P is its perimeter. Thus where the ink has a viscosity of 10 cP and a density of 900 $kg/m^3$ the Reynolds number is 1.4. Temperature variations have a minor effect on the Reynolds number.

The Reynolds number provides an indication of the ratio of inertial to viscous effects. A Reynolds number below 1 indicates that particles suspended in the ink are likely to follow paths perpendicular to surfaces of equal pressure i.e. at the nozzle when the walls are actuated. A value well above 1 means that the inertial effects are dominant and particles are less likely to be deviated upon actuation of the walls. In this case, the Reynolds number is of the order of 1, the momentum of the ink flowing along the channels at a velocity 10 times the maximum printing rate cannot be relied upon to prevent particles from entering the nozzles and causing blockages.

Figure 5:
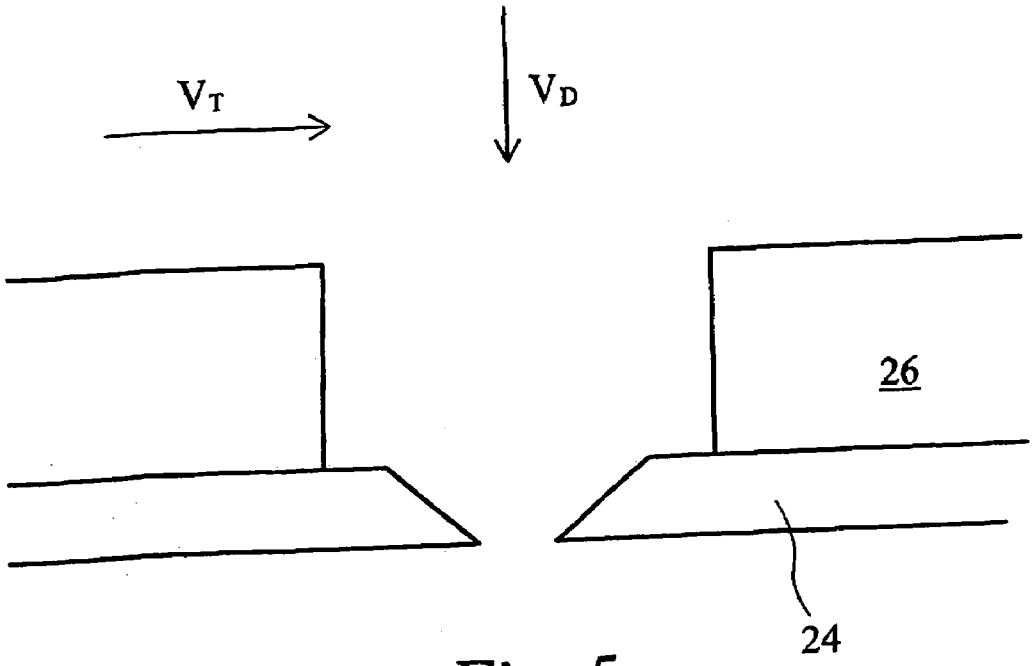
FIG. 5 is an expanded view of the cover plate and nozzle plate of FIGS. 3 and 4.

The arrows $V_T$ and $V_D$ of FIG. 5 represent the flow of the ink along the ink channel and the effective drift velocity towards the nozzle respectively. The drift velocity is equivalent to the maximum flow rate into the nozzle by the area of the cover hole and thus is 0.039 m/s at the maximum printing rate. A high ratio between $V_T$ and $V_D$ means that a particle is less likely to be deflected into the nozzle and that only those particles already at the base of the channel will be deflected. In this case $V_D$ is 29% of $V_T$ which is significant and particles can therefore be deflected into the nozzle from a sizeable region at the bottom of the channel.

Figure 6:
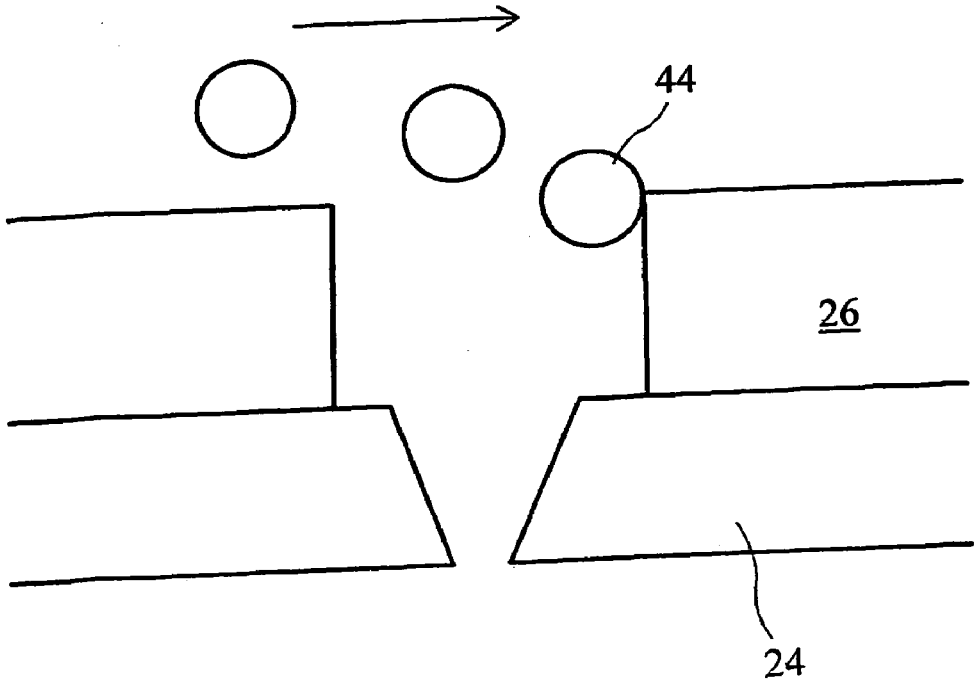
Fig. 6 (Prior Art)
FIG. 6 depicts the path of a particle contained within the ejection fluid in a print head according to the prior art.
Figure 7:
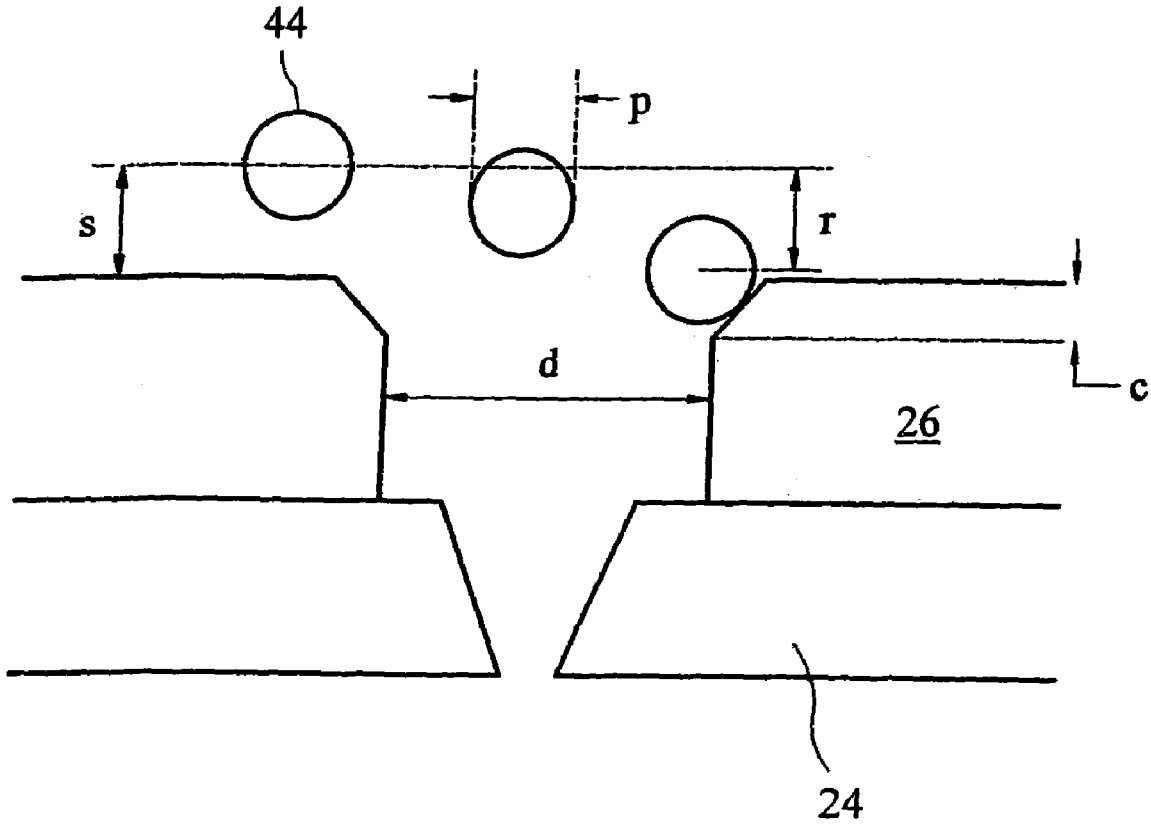
FIG. 7 depicts an expanded view of a cover plate according to the present invention.

FIGS. 6 and 7 depict the movement of a particle 44 towards a nozzle because of the drift velocity $V_D$. As mentioned above, the maximum flow rate through the nozzle is V and the drift velocity is calculated as $V_D = V/_{\pi}d^2/4$. A dirt particle initially centred a distance s from the bottom of the channel drifts downwards by a distance $r = d\ V_D/V_T$. Where s is large and r is small the particle escapes entrainment. If s is small and r is large, the particle is entrained into the nozzle. Where s and r are comparable, the particle will strike the edge of the cover hole.

Where the edge of the port is straight, as in FIG. 6 and according to the prior art, any particle striking the wall or edge of the port has an increased possibility of becoming entrained into the nozzle. Once the particle is present and entrained within the port the ink flow velocity $V_T$ alone is unable to remove the particle without a further maintenance step such as back-flushing or purging.

It has been found, as shown in FIG. 7 and according to the first embodiment of the present invention, that providing a chamfer, of depth c, on the edge of the port increases the possibility that a particle will escape entrainment. Any particle striking the chamfer as in FIG. 7 where $V_T$ is greater than $V_D$ is likely to move back into the through flow. However, where the particle strikes the unchamfered part of the hole (or the edge of the hole in the case where there is no chamfer as in FIG. 6) it is likely to end up in the nozzle and cause a blockage. The critical value for s likely to cause entrainment of a particle into the nozzle can be defined as any value where $s<r-c$.

Particles tend to be equally distributed across the height h of the channel. Thus s can have a value between p/2 to (h−p/2). The fraction f of particles entrained is therefore defined as $$f=[(r-c)-(p/2)]/(h-p/2)$$

Figure 8:
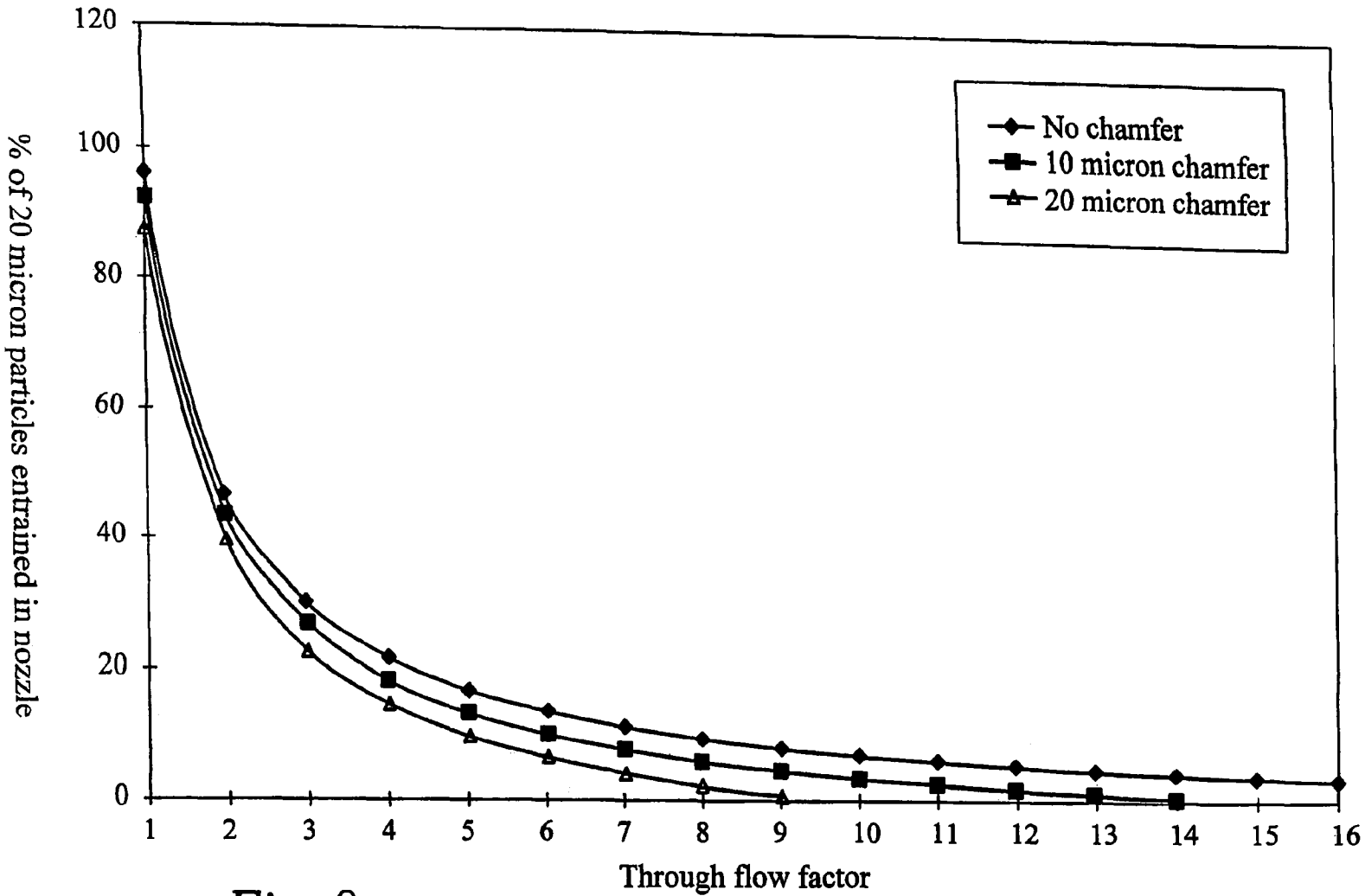
FIG. 8 is a graph depicting the relationship between the through flow factor and the percentage of 20 μm particles entrained for the cover plates of FIG. 6 and FIG. 7.

FIG. 8 shows the relationship between the percentage of particles entrained and the through flow factor and chamfer depth respectively.

A chamfer depth of 20 μm and a chamfer angle of 45° and an ink circulation rate of 10 times the maximum printing rate has been found to reduce the likelihood of a particle being entrained to an insignificant chance whilst still using an acceptable circulation rate.

The chamfer angle in relation to the plane of the plate has been found to be important. Where the angle is too shallow or too steep, regardless of the depth or length of the chamfered portion, the port through the plate effectively acts as if no chamfer is present.

The angle is preferably greater than $\tan^{-1}(V_D/V_T)$ and less than $\tan^{-1}(V_T/V_D)$. Even more preferably the angle is greater than $\tan^{-1}(2(V_D/V_T)$ and less than $\tan^{-1}(½(V_T/V_D)$.

Beneficially the chamfer reduces the requirement for a filter located upstream of the print head to trap particles. This means that the filter can be manufactured to either a lower specification to reduce cost or with a larger pore size thus reducing the pressure drop across it.

It is preferred that the chamfer depth is greater that ½ an average particle size and more preferably greater than or equal to an average particle size. In practice, where a filter is used upstream of the print head, the chamfer will be greater than ½ the pore size and preferably greater than or equal to the pore size.

Figure 9:
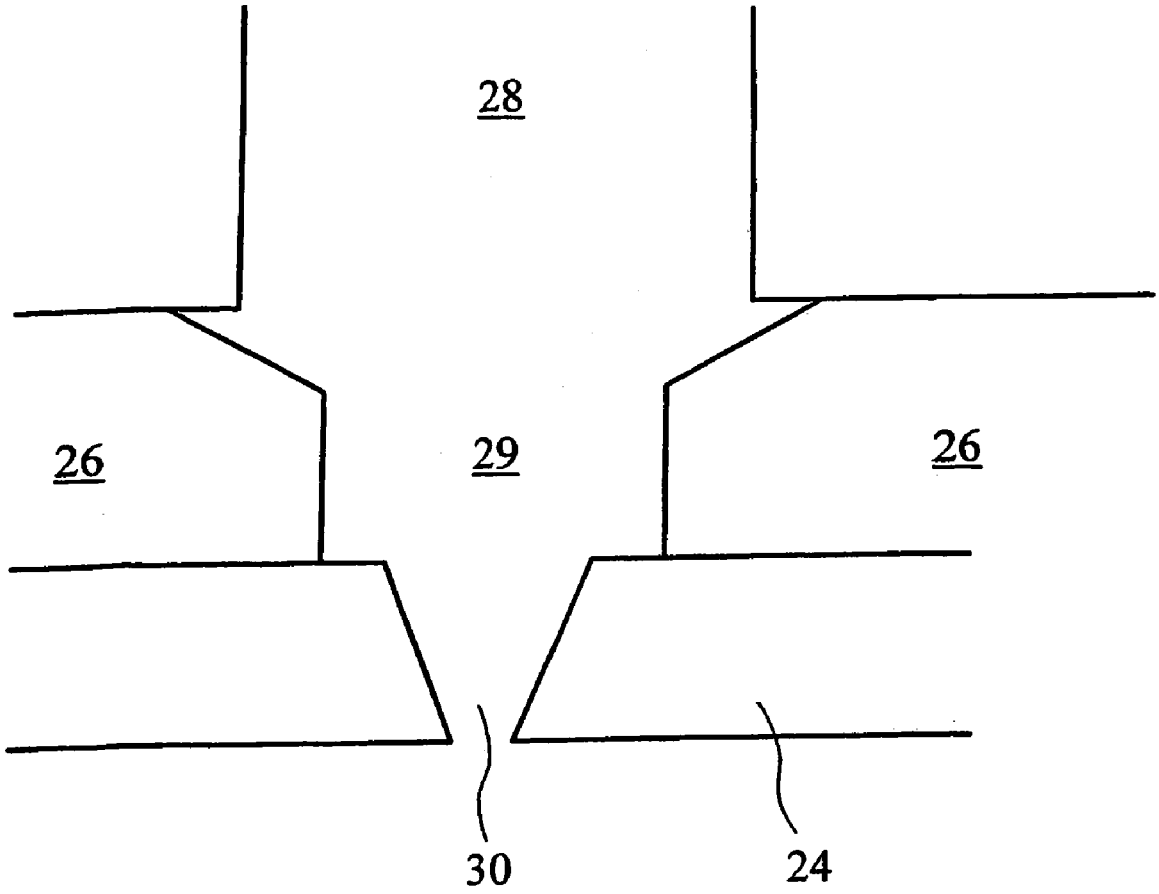
FIG. 9 depicts a chamfer extending beyond one of the boundaries of the channel.
Figure 10:
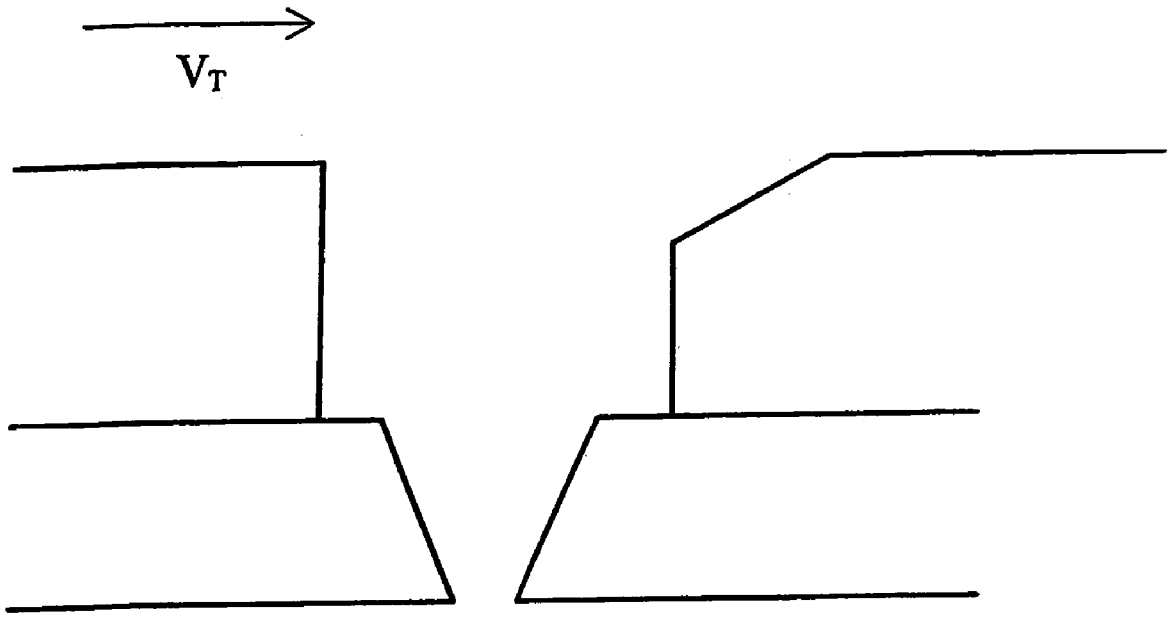
FIG. 10 is a view of a print head according to a second embodiment.

The chamfer angle and depth may be such that the inlet edge extends beyond one of the boundaries of the channel as shown in FIG. 9 which is a cross sectional view across a nozzle 30.

It is also possible to adjust a single edge of the port to reduce the likelihood of blockages as depicted in the alternative embodiments of figures. In this embodiment only the downstream edge of the port is chamfered and this has been found to further reduce the likelihood of a blockage. The angle of chamfer is preferably below 45° and even more preferably below 30° in order to assist the escape of a particle. The angle of the chamfer should not be less than $\tan^{-1}(V_T/V_D)$ in relation to the plane of the plate. In both these embodiments it is preferred that the port is rectangular in order to ease manufacture.

The hole in the port is formed using any suitable technique such as etching, ablation, punching etc. Careful control of this, or a further etching or ablation step allows the chamfer to be formed.

Figure 11:
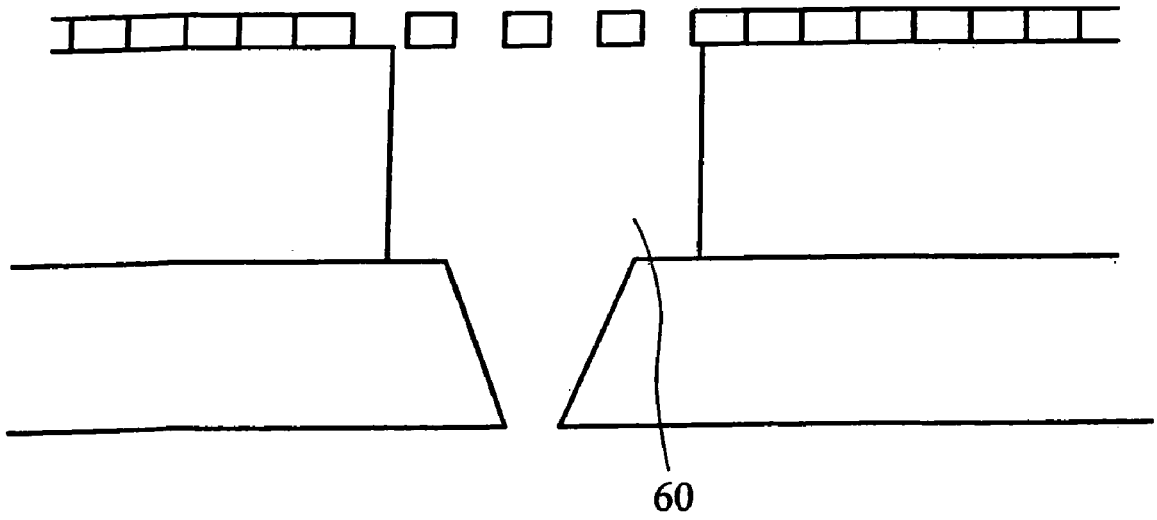
FIG. 11 is a view of a print head according to a third embodiment.

In the alternative embodiment of FIG. 11, a perforated filter layer is provided between the cover plate and the ejection chamber. The size of the pores in the filter layer are such that particles are prevented from entering the nozzle area. It has been found, surprisingly, that this perforated plate does not significantly reduce the efficiency of the print head.

The size of the pore 60 in the cover plate is about 100 μm in diameter. It has been found that pore sizes in the filter layer between 10 μm and 50 μm provide the optimum ejection. A continuous flow through the chamber is still needed though not at levels 10 times the maximum printing rate.

The filter layer is a further plate laminated to and extending substantially over the entire the surface of the cover plate. Perforations are formed in positions corresponding to the ports in the cover plate. These perforations can extend over a relatively large area to ease alignment. The plate can be formed of any suitable, ink compatible material and polyimide has been found to be particularly appropriate. The filter pores can be manufactured by ablation, etching or any other suitable process.

Whilst the present invention has been described with respect to debris and particles in the fluid it is equally compatible with limiting the effects of air bubbles entrained in the fluid Each feature disclosed in this specification (which term includes the claims) and/or shown in the drawings may be incorporated in the invention independent of or in combination with other disclosed and/or illustrated features.

The invention claimed is:

1. Droplet deposition apparatus comprising an elongate chamber extending between a fluid inlet and a fluid outlet; a fluid supply providing in use for a flow along the length of the chamber of velocity VT; an ejection port located between the fluid inlet and the fluid outlet and directed orthogonally of the length of the chamber, there being detritus in the supplied fluid having a drift velocity VD in the direction of the ejection port, wherein there is provided a deflection surface opposing the fluid inlet at the junction of the chamber and the ejection port to deflect into the chamber detritus drifting into the ejection port.

2. Apparatus according to claim 1, wherein the angle of the deflection surface to the length of the chamber is greater than $\tan^{-1}(VD/VT)$.

3. Apparatus according to claim 1, wherein the angle of the deflection surface to the length of the chamber is less than $\tan^{-1}(VT/VD)$.

4. Apparatus according to claim 1, wherein the angle of the deflection surface to the length of the chamber is greater than $\tan^{-1}(2(VD/VT))$.

5. Apparatus according to claim 1, wherein the angle of the deflection surface to the length of the chamber is less than $\tan^{-1}(\frac{1}{2}(VT/VD))$.

6. Apparatus according to claim 1, wherein the deflection surface is defined as a chamfer between orthogonal surfaces of the ejection port and the chamber, respectively.

7. Droplet deposition apparatus comprising an elongate chamber extending between a fluid inlet and a fluid outlet; a fluid supply pmviding in use for a flow along the length of tho chamber of velocity VT; an ejection port located between the fluid inlet and the fluid outlet and directed orthogonally of the length of the chamber, there being detritus in the supplied fluid having a drift velocity VD in to direction of the ejection port, wherein there is provided a deflection surface opposing the fluid inlet at the junction of the chamber and the ejection port to deflect into the chamber detritus drifting into the ejection port, wherein the angle of the deflection surface to the length of the chamber is greater than $\tan^{-1}(VD/VT)$ and less than $\tan^{-1}(VT/VD)$.

8. Apparatus according to claim 7, wherein the angle of the deflection surface to the length of the chamber is greater than $\tan^{-1}(2(VD/VT))$ and less than $\tan^{-1}((\frac{1}{2}(VT/VD))$.

* * * * *